US009175511B2

(12) United States Patent
Whytlaw

(10) Patent No.: US 9,175,511 B2
(45) Date of Patent: Nov. 3, 2015

(54) RETRACTABLE LOUVRE SYSTEM

(75) Inventor: Michael Whytlaw, Wodonga (AU)

(73) Assignee: Advanced Design Innovations Pty Limited, Wodonga, Victoria (AU)

( * ) Notice: Subject to any disclaimer, the term of this patent is extended or adjusted under 35 U.S.C. 154(b) by 12 days.

(21) Appl. No.: 14/234,978

(22) PCT Filed: Jul. 26, 2012

(86) PCT No.: PCT/AU2012/000888

§ 371 (c)(1),
(2), (4) Date: Aug. 27, 2014

(87) PCT Pub. No.: WO2013/016761

PCT Pub. Date: Feb. 7, 2013

(65) Prior Publication Data

US 2015/0152682 A1 Jun. 4, 2015

(30) Foreign Application Priority Data

Jul. 29, 2011 (AU) ..... 2011903048

(51) Int. Cl.
*E06B 9/302* (2006.01)
*E06B 9/36* (2006.01)
*E06B 7/096* (2006.01)

(52) U.S. Cl.
CPC ..... *E06B 9/362* (2013.01); *E06B 7/096* (2013.01)

(58) Field of Classification Search
CPC ..... E06B 9/362; E04B 7/163; E04B 7/166; E04F 10/10
USPC ..... 160/201, 206, 218, 168.1 V, 176.1 V
See application file for complete search history.

(56) References Cited

U.S. PATENT DOCUMENTS

| | | | | |
|---|---|---|---|---|
| 2,135,647 | A | 11/1938 | Streby | |
| 2,581,827 | A * | 1/1952 | Zveibil | 160/62 |
| 2,957,520 | A * | 10/1960 | Howard | 160/113 |
| 3,280,891 | A | 10/1966 | Eldredge, Jr. et al. | |
| 3,661,431 | A * | 5/1972 | Wisecarver | 384/55 |
| 5,291,946 | A * | 3/1994 | Ciriaci | 160/177 R |
| 6,076,588 | A * | 6/2000 | Swiszcz et al. | 160/168.1 V |
| 2002/0166643 | A1 * | 11/2002 | Anderson et al. | 160/168.1 V |
| 2014/0130988 | A1 * | 5/2014 | Frigerio | 160/138 |
| 2014/0175240 | A1 * | 6/2014 | Selzer | 248/237 |

FOREIGN PATENT DOCUMENTS

CH 664419 A5 2/1988

* cited by examiner

*Primary Examiner* — Katherine Mitchell
*Assistant Examiner* — Abe Massad
(74) *Attorney, Agent, or Firm* — McDonnell Boehnen Hulbert & Berghoff LLP

(57) ABSTRACT

The invention concerns an architectural cover for application to a roof or wall. In particular it concerns a rectangular architectural roof cover (or wall mounted shading device) that includes retractable and moveable louvres, comprising: A near end of the rectangle and a far end of the rectangle. Two spaced apart beams forming the left and right sides of the rectangle. A series of louvres spanning between the two beams. Wherein, the ends of each louvre are connected to a respective carriage. The carriages on one side are mounted to run to and fro along one of the beams, and the carriages on the other side are mounted to run to and fro along the other beam. A mechanism is provided to drive the distal carriage on each side to and fro to extend and retract the louvres.

12 Claims, 3 Drawing Sheets

RETRACTABLE LOUVRE SYSTEM

RELATED APPLICATIONS

This application is a U.S. national phase of International Application No. PCT/AU2012/000888 filed Jul. 26, 2012, which claims priority to Australian Application No. 2011903048 filed Jul. 29, 2011, the disclosures of which are incorporated herein by reference in their entirety.

TECHNICAL FIELD

The invention concerns an architectural cover for application to a roof or wall. In particular it concerns a cover that includes retractable and moveable louvres.

BACKGROUND ART

Roofing systems are known that incorporate moveable louvres to enable the roof to be opened or closed. When the roof is open the louvres may be angled to allow a selected amount of sunlight to enter.

Wall mounted louvres acting as a shading device work in the same manner. Wall mounted louvres can be orientated either vertically or horizontally.

DISCLOSURE OF THE INVENTION

The invention is a rectangular architectural roof cover (or wall mounted shading device) that includes retractable and moveable louvres, comprising:

A near end of the rectangle and a far end of the rectangle.

Two spaced apart beams forming the left and right sides of the rectangle.

A series of louvres spanning between the two beams.

Wherein,

The ends of each louvre are connected to a respective carriage.

The carriages on one side are mounted to run to and fro along one of the beams, and the carriages on the other side are mounted to run to and fro along the other beam.

A mechanism is provided to drive the distal carriage on each side to and fro to extend and retract the louvres.

All the carriages on the same side are also interconnected by a pantograph such that each carriage is maintained vertical as the distal carriage is driven to and fro, and such that all the carriages are maintained equally spaced from each other regardless of the location of the distal carriage.

In order to maintain each carriage vertical, the pantograph may involve incorporation of vertical slots in the carriages to capture pins associated with one side of the pantograph. In this case pins associated with the other side of the pantograph may be captured in apertures vertically below the slots in such a way that they cannot move in translation, but only in rotation. This is one way in which the carriages may be maintained rigidly vertical as the cover is opened and closed.

An advantage of keeping the carriages rigidly vertical is that it eliminates the need for more than one wheel at the top and bottom of the carriage; or any alternative stabilizing means. This in turn makes the overall width of the carriage smaller, which means the distance between the stacked louvres is reduced, which is an architectural advantage since it results in the opening being larger when the cover is retracted.

An end guide may be fixed and stationary adjacent the near end of the beams to capture the near end of the pantograph. In the case where the carriages have a vertical slot above apertures, the same configuration of slot and aperture may be applied to the end guides.

The distal carriage may be driven to and fro by a wormgear that extends along the length of the beam. To drive the wormgear a worm gear box may be provided at the near end of the beam.

At least on one side, each louvre may also be attached to a respective carriage via a bracket and a gearbox mounted in the carriage. Such a connection between the louvres and carriages helps to decouple any moments that deflection of the louvres will cause. This prevents any adverse bending forces from being transferred back into the carriage, wheels and pantograph.

The gearbox mounted in the carriages may be a low friction gearbox, such as a worm gearboxes, and it moves the brackets to rotate the louvres. All the worm gearboxes may be driven at the same time by a shaft that extends through the gearbox in each carriage. In this way all the louvres may be opened and closed in synchronism with each other.

The upper and lower wheels of each carriage may run in a respective tracks mounted in the beam. The tracks may have triangular cross-section and the wheels may have 'V'-shaped rims that receive the apex of the tracks. This arrangement makes cleaning easier if dust or dirt enters the track system.

BRIEF DESCRIPTION OF THE DRAWINGS

An example of the invention applied to a roof, will now be described with reference to the accompanying drawings, in which:

FIG. 1(*b*) is a plan view of a retracted roof cover.

FIG. 2(*b*) is an end elevation of the retraction mechanism.

BEST MODES OF THE INVENTION

Figure 1A:
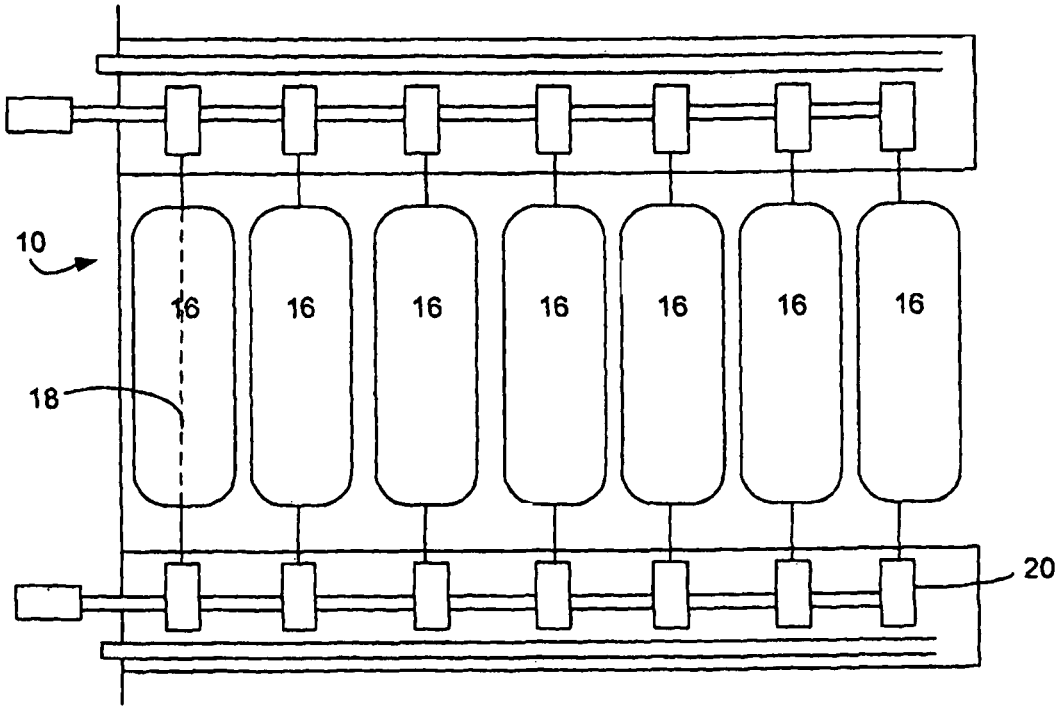
FIG. 1(*a*) is a plan view of an extended and closed roof cover.
Figure 1B:
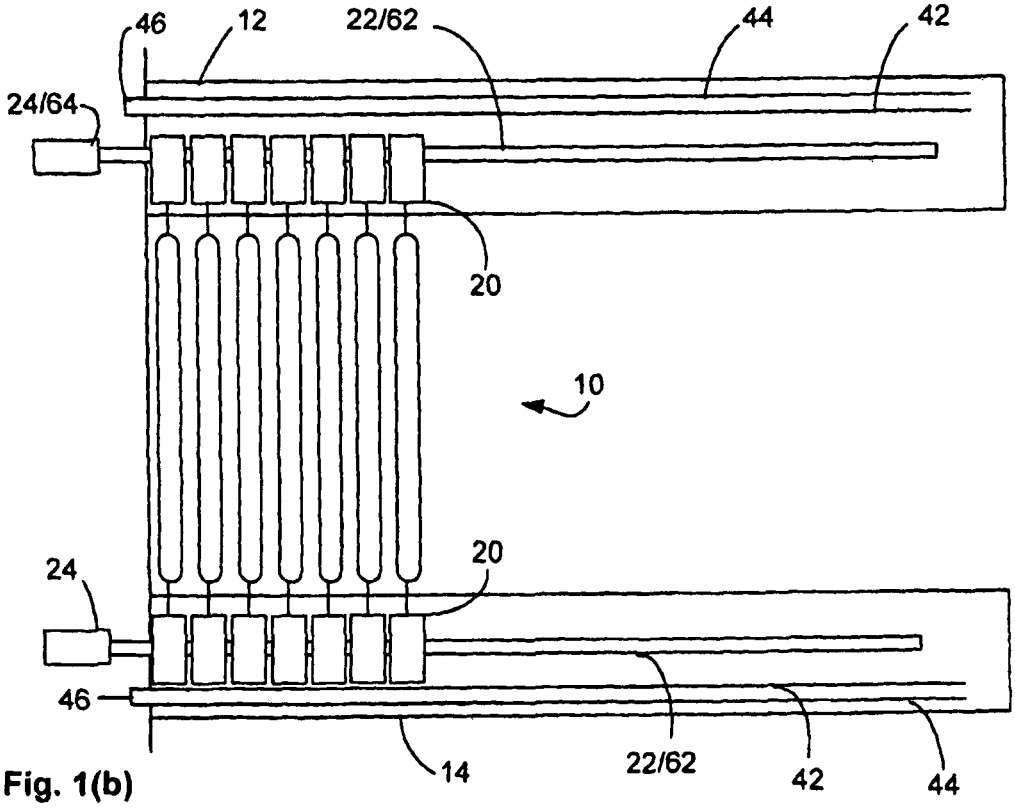

Referring first to FIG. 1 the area that may be covered by the roof 10 is defined by two spaced apart beams 12 and 14. A series of moveable louvres 16 span between beams 12 and 14. The louvres 16 may be extended across the roof, as shown in FIG. 1(*a*), where the louvres 16 are also oriented horizontally to seal the roof closed. Alternatively the louvres 16 may be opened to any desired degree by rotating them about their horizontal axes 18. When opened the louvres may be retracted partially, or completely as shown in FIG. 1(*b*).

Figure 2A:
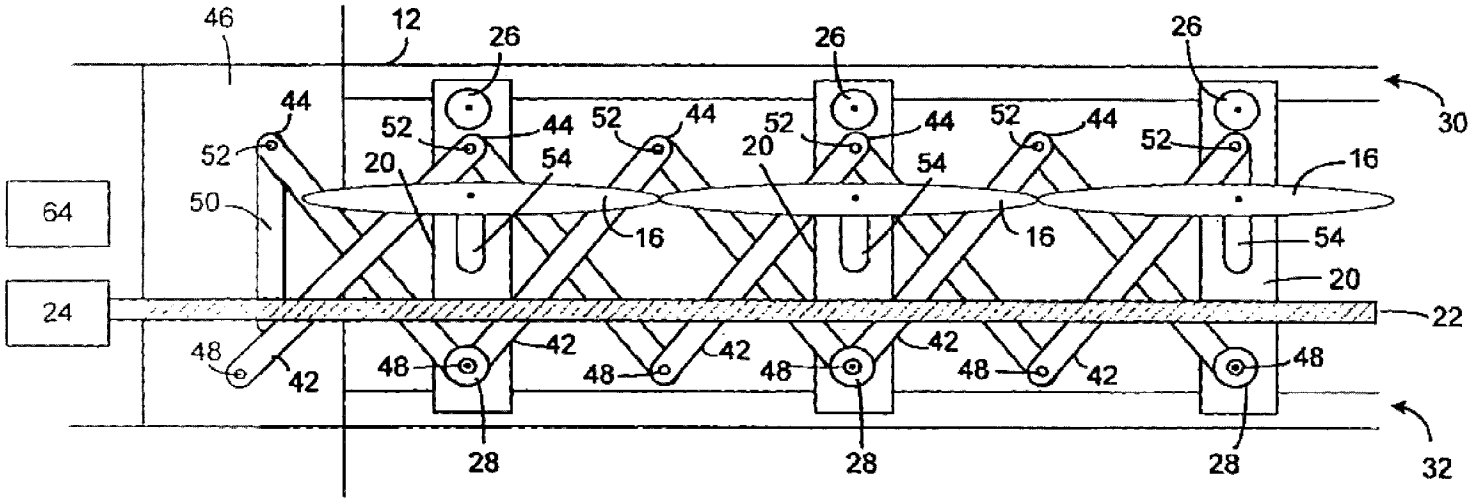
FIG. 2(*a*) is a side elevation showing the first three louvres and their associated carriages and retraction mechanism.
Figure 2B:
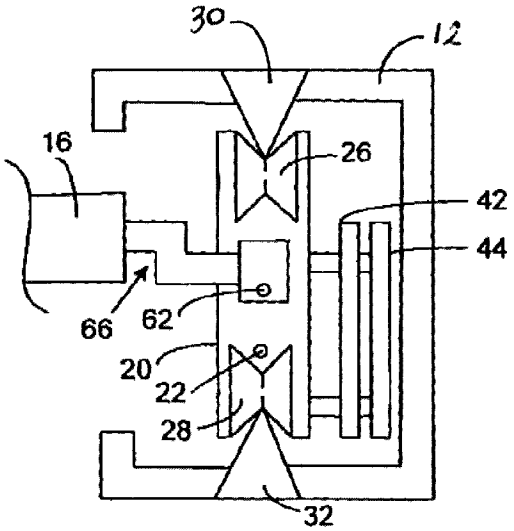

At either end each of the louvres 16 is mounted into a respective carriage 20. The distal one of carriages 20 is has a fixed nut that rides on a wormgear 22 that passes through each of the other carriages 20. The wormgear 22 is driven from a drive motor 24. Each carriage 20 has an upper and a lower wheel 26 and 28 that runs in a respective track 30 and 32; as shown in FIGS. 2(*a*) and (*b*). The tracks 30 have triangular cross-section and the wheels 26 and 28 have 'V'-shaped rims that receive the apex of the tracks 30. This arrangement makes cleaning easier if dust or dirt enters the track system. An enclosure (not shown) completes the track system.

The carriages 20 are also interconnected by a pantograph 42/44 that has a series of inner arms 42 and a series of outer arms 44. An end guide 46 is fixed and stationary adjacent the drive motor 24. The end guide has a lower hole to receive pin 48 at the lower end of the first inner arm 42. It also has a vertical slot 50 to receive pin 52 at the upper end of first outer arm 44.

Thereafter the lower ends of the inner arms 42 and outer arms 44 are pinned together by pins 48. Every other pin 48 also pins the lower ends of the inner and outer arms to a carriage 20, and these pins are coaxial with the lower wheel 28.

The upper ends of the inner arms 42 and the outer arms 44 are also pinned together by pins 52. Every other pin 52 also pins the upper ends of the arms to a vertical slot 54 in carriages 20.

Starting from the retracted position of FIG. 1(*b*) the drive motor 24 is operated to drive the worm gear 22 to carry the distal carriage 20 to the right. As this happens all the other carriages 20 are moved proportionately to the right as well, by operation of the pantograph. As the leading carriage moves laterally, the angle between interconnecting pantograph arms changes and expands. The upper pins 52 all fall in slots 50 and 54, the angle between each pantograph arm remains equal, which keeps the distance between each carriage 20 the same. The pantograph also keeps all the carriages 20 rigidly vertical at all times; see FIG. 3.

Figure 3:
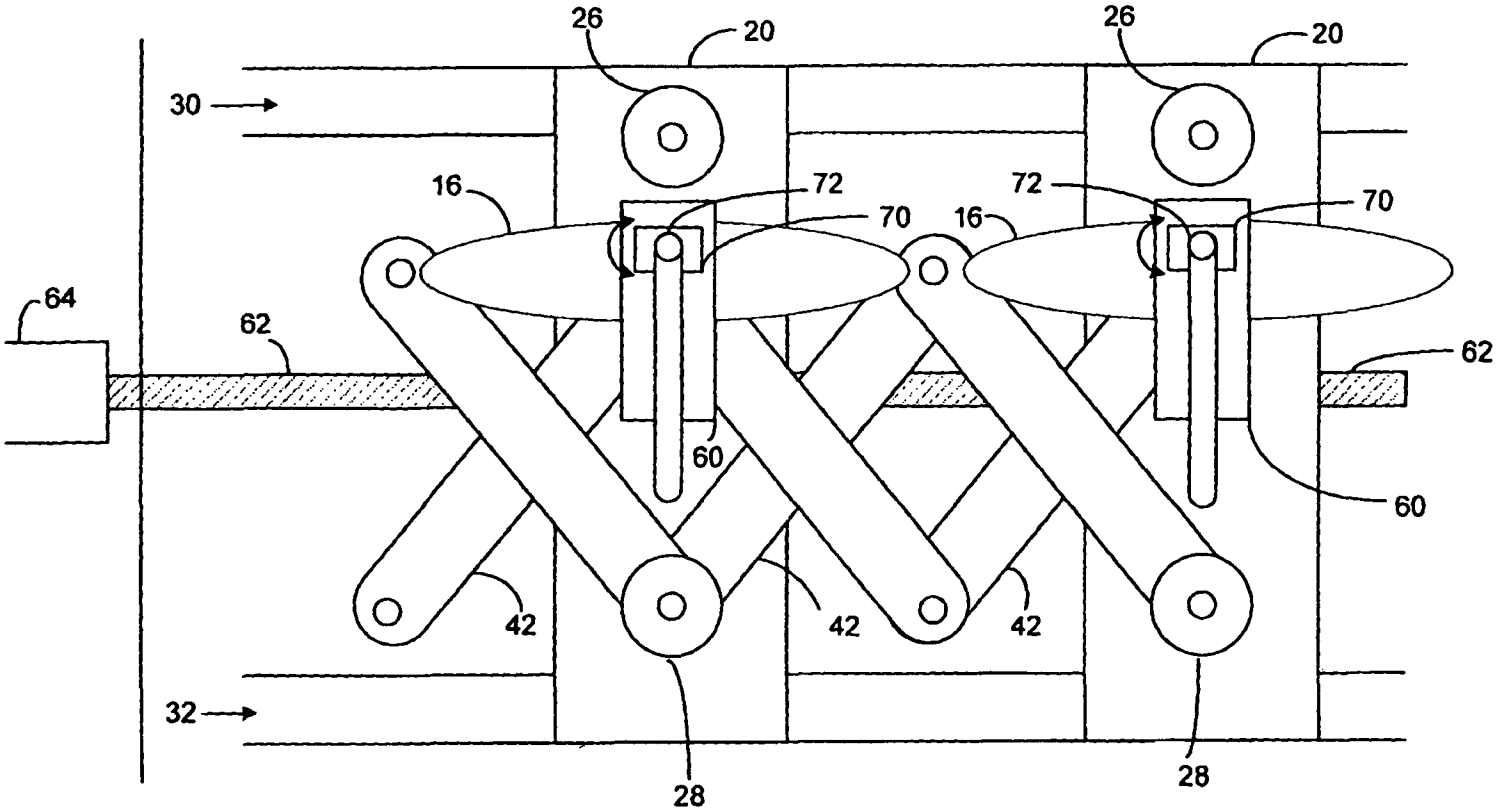
FIG. 3 is a detailed side elevation of two carriages showing their interengagement with the pantograph and louvres.

Referring further to FIG. 3, on one side each of the louvres 16 are attached to the carriages 20 via a gearbox 60 and bracket 70. Each gearbox 60 has an output shaft 72 fixed to a corresponding bracket 70 to which each louvre 16 is fastened. The gearboxes 60 are low friction gearboxes, such as worm gearboxes, and another drive shaft 62 passes through each gearbox 60. In use the drive shaft 62 is driven in rotation by master gearbox 64. As the drive shaft 62 rotates it causes internal gears (not shown) to turn the output shaft 72 of every gearbox 60, and consequently rotates each bracket 70 (indicated by double ended arrows) and each of the louvres 16; to open and close the louvres.

Although the invention has been described with reference to a particular example it may be exemplified in many other forms. For instance the connections between the louvres, pantographs and gearboxes may be effected by any other suitable means.

The invention claimed is:

1. An architectural roof or wall mounted shading device that includes retractable and reorientable louvres, comprising:

a pair of spaced apart parallel beams each having a first end and an opposite second end, and each defining a longitudinal axis;

a first series of carriages mounted to run to and fro along one of the beams;

a second series of carriages mounted to run to and fro along the other of the beams;

a series of louvres spanning between the beams, each of the louvres having a first end connected to a respective one of the first series of carriages and an opposite second end connected to a respective one of the second series of carriages;

a mechanism to drive the carriages to and fro along their respective beams to extend and retract the louvres;

a first pantograph interconnecting the first series of carriages to maintain an equal spacing between each of the carriages in the first series of carriages as they are driven to and fro; and a second pantograph interconnecting the second series of carriages to maintain an equal spacing between each of the carriages in the second series of carriages as they are driven to and fro, wherein each carriage is connected to the respective pantograph at two points spaced apart in a direction perpendicular to the longitudinal axis to maintain each carriage perpendicular to the longitudinal axis; wherein an elongate slot oriented perpendicular to the longitudinal axis is provided in each of the carriages to receive a respective one of a first series of pins of the associated pantograph, wherein engagement of the pins in the slots defines a first of the two connection points between the carriages and respective pantograph.

2. The shading device of claim 1, wherein an aperture is provided in each of the carriages at a location spaced apart, in a direction perpendicular to the longitudinal axis, from the slot, the aperture being engageable with a respective one of a second series of pins of the associated pantograph, such that when so engaged the aperture and respective pin are restrained against relative translation, but not against relative rotation.

3. The shading device of claim 2, wherein the first and second pantographs are each anchored at or adjacent the first end of their respective beams.

4. The shading device of claim 3, wherein the pantographs are anchored to end guides fixedly connected to the beams, the end guides having slots and apertures of the same configuration as the slots and apertures of the carriages.

5. The shading device of claim 1, wherein the mechanism comprises a wormgear that extends along the length of each beam.

6. The shading device of claim 5, wherein a gear box is provided at or adjacent the first end of each beam to drive the wormgear.

7. The shading device of claim 1, wherein a rotating mechanism is associated with at least one of the ends of each louvre to rotate the louvres.

8. The shading device of claim 7, wherein the rotating mechanism comprises a worm gearbox mounted in each of the carriages to rotate the louvres.

9. The shading device of claim 8, wherein a said rotating mechanism is associated with both ends of each louvre, and wherein the rotating mechanisms are configured to be actuated simultaneously to rotate all of the louvres simultaneously.

10. The shading device of claim 1, comprising wheels on opposite ends of each carriage, the wheels running in respective tracks of the beams.

11. The shading device of claim 10, wherein the tracks have a triangular cross-section and the wheels have 'V'-shaped rims that receive an apex of the tracks.

12. The shading device of claim 1, wherein the first and second pantographs are each anchored at or adjacent the first end of their respective beams.

* * * * *